US007030720B2

(12) United States Patent
Lo Hine Tong et al.

(10) Patent No.: US 7,030,720 B2
(45) Date of Patent: Apr. 18, 2006

(54) FLOATING MICROWAVE FILTER IN A WAVEGUIDE STRUCTURE

(75) Inventors: Dominique Lo Hine Tong, Rennes (FR); Ali Louzir, Rennes (FR); Philippe Chambelin, Chateaugiron (FR); Christian Person, Locmaria Plouzar (FR); Jean-Philippe Coupez, Le Relecq Kerhuon (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/812,131

(22) Filed: Mar. 29, 2004

(65) Prior Publication Data

US 2004/0201437 A1 Oct. 14, 2004

(30) Foreign Application Priority Data

Mar. 31, 2003 (FR) ..... 03 03923

(51) Int. Cl.
*H01P 1/207* (2006.01)
*H01P 11/00* (2006.01)

(52) U.S. Cl. ..... 333/208; 29/600

(58) Field of Classification Search ..... 333/208, 333/209, 239; 29/600
See application file for complete search history.

(56) References Cited

U.S. PATENT DOCUMENTS

| | | | | |
|---|---|---|---|---|
| 2,783,440 | A * | 2/1957 | Lovick, Jr. | 333/239 |
| 3,914,713 | A * | 10/1975 | Konishi et al. | 333/21 R |
| 4,521,755 | A * | 6/1985 | Carlson et al. | 333/244 |
| 4,897,623 | A | 1/1990 | Reindel | 333/208 |
| 4,990,870 | A | 2/1991 | Reindel | 333/208 |
| 5,818,313 | A * | 10/1998 | Estes et al. | 333/202 |

FOREIGN PATENT DOCUMENTS

FR 2829620 3/2003

OTHER PUBLICATIONS

Harel et al., "Foam Technology for integration of millimetre-wave 3D functions," Electronics Letters, Vo. 35, No. 21, Oct. 14, 1999, pp. 1853-1854.*

* cited by examiner

*Primary Examiner*—Seungsook Ham
(74) *Attorney, Agent, or Firm*—Joseph J. Laks; Robert D. Shedd; Brian J. Cromarty

(57) ABSTRACT

A floating microwave filter in a waveguide structure comprises filtering elements sandwiched between two foam half-bars that are placed inside a waveguide. The filtering elements are metal features etched in the surface of one of the two foam half-bars and the waveguide is an internally hollowed-out block of foam having a metallized external surface.

7 Claims, 1 Drawing Sheet

FLOATING MICROWAVE FILTER IN A WAVEGUIDE STRUCTURE

This application claims the benefit under 35 U.S.C. § 119 of French application number 0303923, filed Mar. 31, 2003.

BACKGROUND OF THE INVENTION

A floating microwave filter in a waveguide structure has been described in particular in patent document U.S. Pat. No. 4,990,870.

Conventional microwave filters in a waveguide structure use filtering elements that are in electrical and mechanical contact with the walls of the waveguide. In a technology known as "Finline" or a technology called "E plane", resonant metal features are etched either in a thin dielectric substrate or directly in a metal foil. This etched substrate or foil is then attached in the E plane of a rectangular waveguide, which ensures perfect positioning of the substrate or foil in the waveguide and perfect electrical continuity between the metal walls of the waveguide and the metallized portions of the substrate or foil.

In a floating microwave filter in a waveguide structure, the filtering elements are not in electrical and mechanical contact with the walls of the waveguide.

The floating microwave filter in a waveguide structure known from the aforementioned document is assembled by inserting a printed circuit mounted on the back of a foam bar into a metal waveguide of rectangular cross section and in a plane parallel to the short side of the cross section of the waveguide, which simplifies the assembly technique compared to that of a conventional filter and reduces the production costs. Moreover, a floating microwave filter in a waveguide structure has, compared with a conventional filter, improved characteristics as regards insertion losses.

SUMMARY OF THE INVENTION

It is an object of the invention to improve a floating microwave filter in a waveguide structure in order to further lower the manufacturing costs.

According to the invention, a floating microwave filter in a waveguide structure, comprising filtering elements sandwiched between two foam half-bars that are placed inside a waveguide, is characterized in that the filtering elements are metal features etched in the surface of one of the two foam half-bars and in that the waveguide is an internally hollowed-out block of foam having a metallized outer surface.

This arrangement helps to lower the manufacturing costs of a floating microwave filter at the same time as improving the performance of the filter (low insertion losses and high selectivity).

DESCRIPTION OF THE DRAWINGS

Illustrative embodiments of a floating microwave filter according to the invention are described below and illustrated in the drawings.

DESCRIPTION OF PREFERRED EMBODIMENTS

Figure 1:
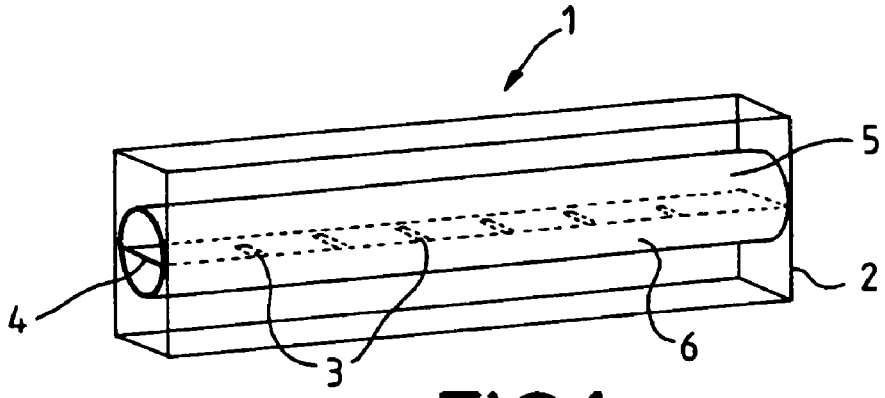
FIG. 1 shows schematically, in perspective, a first embodiment of a floating microwave filter according to the invention whose waveguide of rectangular cross section has an internal cavity of circular cross section.

FIG. 1 shows a floating microwave filter in a waveguide structure 1 comprising a waveguide 2 of rectangular cross section in the form of an internally hollowed-out parallelepipedal block of foam whose external surface has been metallized.

The foam used is preferably a polymethacrylimide foam known for its electrical properties similar to those of air, for its mechanical properties of stiffness and lightness and for its low manufacturing cost. In particular, a polymethacrylimide foam sold under the name ROHACELL HF may be used.

The foam block 2 is preferably metallized nondirectionally, by spraying, or brushing on, a paint of the silver or derivative type exhibiting conductivity and mechanical bonding characteristics.

The foam block constituting the waveguide 2 has an internal axial cavity of cylindrical cross section. The cylindrical cavity may be produced by drilling or moulding. The cylindrical shape of the cavity has the advantage of ensuring that the filter array is correctly positioned with respect to the walls of the waveguide.

The floating filter 1 comprises filtering elements 3 inserted in an axial plane 4 of a cylindrical foam bar. More particularly, the cylindrical foam bar consists of two identical superposed half-bars 5, 6 and the filtering element 3 sandwiched between the two foam half-bars are features etched into the surface of one of the two foam half-bars, for example in the joint surface of the lower foam half-bar 6 in FIG. 1.

The foam used for the foam bars is the same as that used for the foam waveguide 2. The features of the filter array are etched as indicated above in the case of metalization of the external surface of the foam waveguide.

The two superposed foam half-bars 5, 6 with the etched filtering elements 3 sandwiched between the two foam half-bars are inserted into the cylindrical cavity of the foam waveguide.

Figure 2:
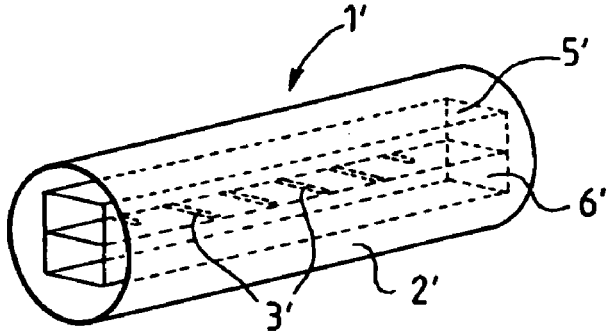
FIG. 2 shows schematically, in perspective, a second embodiment of a floating microwave filter according to the invention whose waveguide of circular cross section has an internal cavity of rectangular cross section.

FIG. 2 shows another embodiment of a floating microwave filter in a waveguide structure according to the invention. This floating filter 1' comprises a foam waveguide 2' of circular cross section in which a parallelepipedal internal cavity of rectangular cross section is formed. The features 3' of the filter array are sandwiched between two superposed foam half-bars 5' 6' forming a parallelepipedal bar.

Figure 3:
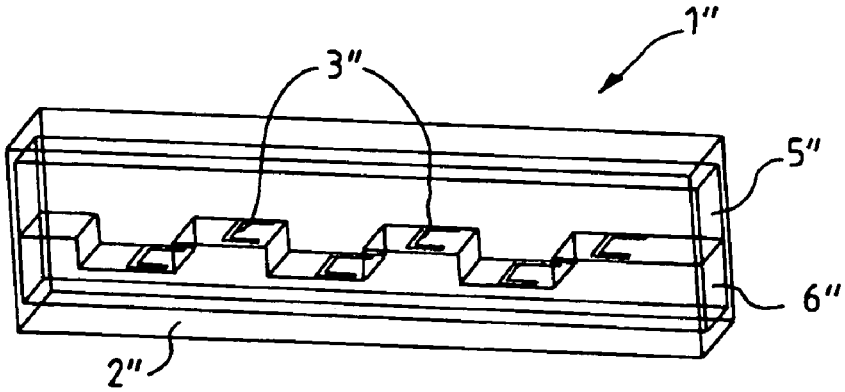
FIG. 3 shows schematically, in perspective, a third embodiment of a floating microwave filter according to the invention whose waveguide of rectangular cross section has an internal cavity of rectangular cross section, into which cavity two superposed foam half-bars are inserted, these having a joint surface that forms crenellations.

FIG. 3 shows yet another embodiment of a floating microwave filter in a waveguide structure according to the invention. This floating filter 1" comprises a foam waveguide 2" of rectangular cross section in which a parallelepipedal internal cavity of rectangular cross section is formed. The features 3" of the filter array are sandwiched between two superposed foam half-bars 5", 6" forming a parallelepipedal bar. The joint surface of the two half-bars 5", 6" is crenellated and the features 3" of the filter array are placed on the top and bottom portion of the crenellation. The resonant metal features could be placed both on the half-bar 5" and the half-bar 6". This arrangement makes it possible to produce complex filtering functions. It is known that the synthesis of a transfer function of a filter consists in adjusting the resonant frequencies of a cascade of resonators and in adjusting the coupling between two neighbouring resonators. Adjusting the height of the crenellations results in a wider range of adjustment in the case of the resonant frequency of the resonator and also in a wider range of variation of the coupling between neighbouring resonators.

The process according to the invention can be applied to a foam waveguide having a cavity of elliptical, square, diamond or other cross section.

What is claimed is:

1. Floating microwave filter in a waveguide structure, comprising filtering elements sandwiched between two foam half-bars that are placed inside a waveguide, wherein one of the two foam half-bars comprises the filtering elements made of metal features and the waveguide is an internally hollowed-out block of foam having a metallized outer surface.

2. Filter according to claim 1, wherein the foam waveguide has a rectangular cross section and an internal cavity of circular cross section.

3. Filter according to claim 1, wherein the foam waveguide has a circular cross section and an internal cavity of rectangular cross section.

4. Filter according to claim 1, wherein the foam waveguide has a rectangular cross section and an internal cavity of rectangular cross section.

5. Filter according to claim 1, wherein the surface of the foam bar on which the metal features are placed is crenellated.

6. Process for manufacturing a floating filter in a waveguide structure comprising elements sandwiched between foam half-bars that are placed inside a waveguide, the process comprising a step of forming the metal features constituting the filtering elements by spraying a metal paint onto the surface of one of the foam half-bars.

7. Process for manufacturing a floating filter in a waveguide structure comprising elements sandwiched between foam half-bars that are placed inside a waveguide, the process comprising a step of forming the metal features constituting the filtering elements by brushing on a metal paint onto the surface of one of the foam half-bars.

* * * * *